US006429600B1

(12) United States Patent
Fujita et al.

(10) Patent No.: US 6,429,600 B1
(45) Date of Patent: Aug. 6, 2002

(54) LIGHT EMITTING DISPLAY DEVICE HAVING LUMINANCE COMPENSATING CIRCUITRY

(75) Inventors: Susumu Fujita; Hiroshi Odagiri; Kazumi Sakumoto; Masafumi Hoshino; Tokuya Akase, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/587,024

(22) Filed: Jun. 5, 2000

(30) Foreign Application Priority Data

Jun. 6, 1999 (JP) ..... 11-153934

(51) Int. Cl.[7] ..... G09F 9/32
(52) U.S. Cl. ..... 315/169.3; 315/164; 345/204
(58) Field of Search ..... 315/169.3, 164; 323/311, 312; 345/204, 209

(56) References Cited

U.S. PATENT DOCUMENTS 4,160,241 A * 7/1979 Shimizu et al. ..... 340/763
4,864,216 A * 9/1989 Kalata et al. ..... 323/315
5,959,413 A * 9/1999 Komarek et al. ..... 315/306

* cited by examiner

*Primary Examiner*—David Vu
(74) *Attorney, Agent, or Firm*—Adams & Wilks

(57) ABSTRACT

In a light emitting indicator drive circuit which supplies a current to display elements different in display areas, a current control circuit controls the supply current of a constant-current source which is caused by a p-channel MOS-FET which supplies a current to a display element. The current control circuit controls the off-operation of the FET. A signal processing circuit calculates the deterioration data from a deterioration detecting circuit and saved segment area data to decide a supply current value to display elements as a result of the arithmetic operation. With the above operation, a difference in luminance between the display elements and the degradation of luminance caused by the deterioration can be corrected.

19 Claims, 9 Drawing Sheets

LIGHT EMITTING DISPLAY DEVICE HAVING LUMINANCE COMPENSATING CIRCUITRY

BACKGROUND OF THE INVENTION

1. Field of the Invention

The present invention relates to a light emitting display device having an indicator that emits a light by supplying a d.c. current thereto and a drive circuit for the indicator, and more particularly to a light emitting indicator drive circuit that conducts a correcting process for reducing a difference in the luminance of emitted light of an indicator having a plurality of display elements each having a different area.

2. Description of the Related Art

FIGS. 8 and 9 show a schematic diagram of a light emitting indicator drive circuit in a conventional light emitting display device and the element shape of a conventional light emitting indicator, respectively. As shown in FIG. 8, display elements 801 to 820 are connected to each other in the form of a matrix. Also, an output of a constant-current source 821 having a switching function and allowing a current to flow out is connected to the plus electrode sides of each of the display elements 801, 806, 811 and 816. Likewise, an output of a constant-current source 822 is connected to the display elements 802, 807, 812 and 817, an output of a constant-current source 823 is connected to the display elements 803, 808, 813 and 818, an output of a constant-current source 824 is connected to the display elements 804, 809, 814 and 819, and an output of a constant-current source 825 is connected to the display elements 805, 810, 815 and 820, respectively. On the other hand, a switch 826 that allows a current to flow into the ground is connected to the minus electrode sides of the display elements 801, 802, 803, 804 and 805, respectively. Likewise, a switch 827 is connected to the display elements 806, 807, 808, 809 and 810, a switch 828 is connected to the display elements 811, 812, 813, 814 and 815, and a switch 829 is connected to the display elements 816, 817, 818, 819 and 820, respectively.

As shown in FIG. 9, in the conventional example, the areas of the display elements 801 to 820 disposed within the light emitting indicator 901 are identical with each other, and the constant current sources 821 to 825 supply the same current. For that reason, the current densities of all the display elements become equal to each other, to thereby obtain substantially the same luminance.

In order to turn on/off the respective display elements, each of the constant current sources 821 to 825 has a switching function so that the respective constant current sources can be turned on/off. On the other hand, the switches 826 to 829 are sequentially turned on one by one in a time sharing manner, and there is no case where two or more switches are turned on at the same time. In the case of turning on the display element 801, the constant current source 821 and the switch 826 are turned on. Similarly, all the display elements can be selectively turned on by the combination of the constant current sources 821 to 825 with the switches 826 to 829.

With the above structure, a very large number of light emitting elements are arranged to conduct dot matrix display, thereby being capable of executing various display.

If the dot matrix display is applied to an indicator such as an arm watch which requires a small size and a low power, the power consumption of the driver and the chip size become large, and also if no fine dot matrix display is used, fine character display cannot be made. In this case, segment display is advantageous, but it is difficult to make the areas of the respective segments identical with each other, as a result of which if the segments are driven by a constant current source having the same current value, the density of current depends on the segments to produce a difference in luminance between the respective segments.

in particular, even a difference in luminance of several percent between the adjacent segments is conspicuous. For that reason, if the luminance between the respective segments is not corrected, the display quality is remarkably degraded so that the dot matrix display cannot be applied to a fashionable wristwatch or the like.

SUMMARY OF THE INVENTION

The present invention has been made to solve the above drawbacks, and therefore an object of the present invention is to provide a light emitting indicator drive circuit which is capable of correcting a difference in luminance between the respective segments to a level where there occurs no problem from the visual viewpoint.

In order to achieve the above object, according to the present invention, there is provided a light emitting indicator drive circuit in which a current value is made variable by a gate voltage of a MOS-FET which is a constant-current source that drives display segments, and the gate voltage is controlled by using segment area information, light emitting characteristic degradation information or the like, or the current is controlled by combination of the on/off states of a plurality of FETs.

According to one aspect of the present invention, there is provided a light emitting display device, comprising a light emitting indicator having a plurality of light emitting elements different in light emitting area, a constant current source that supplies a current to the plurality of light emitting elements, respectively, and a current control circuit that controls the constant current source to supply constant currents to the respective elements corresponding to the areas of the plurality of light emitting elements. With this structure, the currents which are supplied to the respective light emitting elements can be corrected, individually, without the need to increase or reduce a generated current value using a resistor or impedance element so that the light emitting luminances of the plurality of light emitting elements become substantially equal to each other, thereby being capable of reducing a variation in the luminance between the respective display elements.

Also, according to another aspect of the present invention, there is provided a light emitting display device in which a constant current FET is used as the constant current source, and the current control circuit controls the gate voltage of the constant current FET to supply the current corresponding to the areas of the plurality of light emitting elements to the respective light emitting elements. For that reason, a variation in the luminance between the respective display elements can be reduced. By utilizing a plurality of constant current FETs of different driving capabilities, a more fine control of the current is possible.

Further, according to still another aspect of the present invention, there is provided a light emitting display device in which the area information of the plurality of light emitting elements are installed in the interior of the light emitting indicator. With this structure, the current control circuit can read the area information if necessary to correct a current which is supplied to the respective light emitting elements so that the light emitting luminances of the plurality of light emitting elements become substantially constant. In the case where a constant current FET is employed as the constant current source, the current control circuit can read the area information if necessary to correct the gate voltage of the constant current FET so that the light emitting luminances of the plurality of light emitting elements become substantially constant, to thereby control a current which is supplied to the respective light emitting elements. For that reason, a variation in the luminance between the respective display elements can be reduced with high accuracy.

Still further, according to still another aspect of the present invention, there is provided a light emitting display device comprising: a deterioration detecting circuit that detects the deterioration of a light emitting characteristic; and a signal processing circuit that calculates deterioration information outputted from the deterioration detecting circuit and the area information of a plurality of light emitting elements; wherein the current control circuit reduces the deterioration of the light emitting luminance caused by the deterioration of the light emitting indicator on the basis of the output data of the signal processing circuit to correct a current which is supplied to the respective light emitting elements so that the light emitting luminances of the plurality of light emitting elements become substantially constant. In the case where a constant current FET is employed as the constant current source, the current control circuit corrects the gate voltage of the constant current FET to control a current which is supplied to the respective light emitting elements. With the above structure in which the current which is supplied to the light emitting elements can be corrected, even if the display elements are deteriorated with time, a variation in the luminance between the respective display elements can be reduced with high accuracy.

BRIEF DESCRIPTION OF THE DRAWINGS

Other features and advantages will become apparent from the following detailed description when taken in conjunction with the accompanying drawings, in which.

DETAILED DESCRIPTION OF THE PREFERRED EMBODIMENTS

Now, a description will be given in more detail of preferred embodiments of the present invention with reference to the accompanying drawings.

Figure 1:
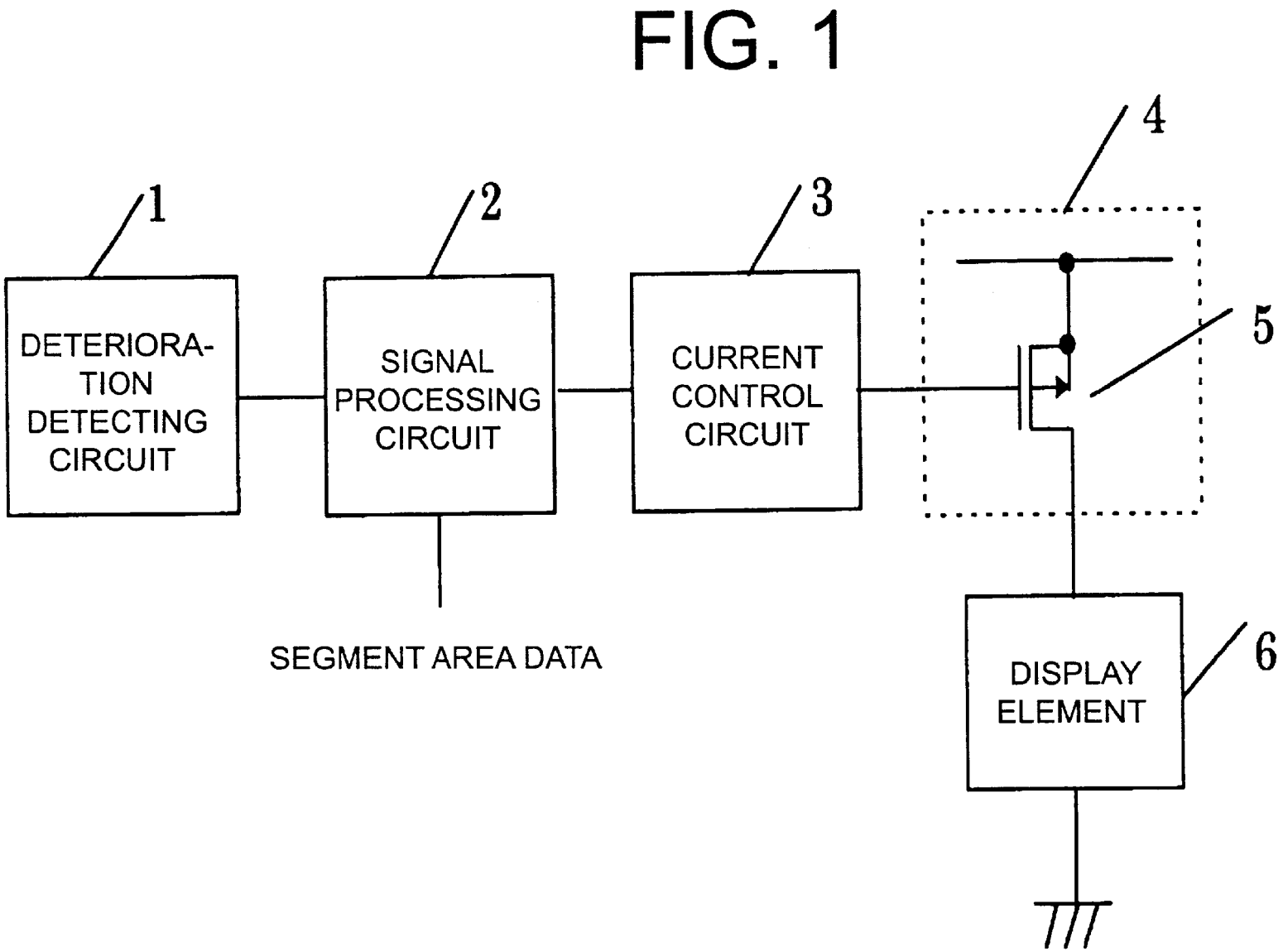
FIG. 1 is a block diagram showing a light emitting indicator drive circuit in accordance with the present invention.

FIG. 1 is a schematic block diagram showing the structure of a light emitting display device in accordance with the present invention. Referring to FIG. 1, a display element 6 is connected with a constant current source 4, a p-channel MOS-FET 5 is disposed in the interior of the constant current source 4, and a current stabilized by the constant current characteristic of the FET 5 is supplied to the display element 6. The gate of the FET 5 is connected with a current control circuit 3. The current control circuit 3 controls the off-operation of the FET 5 and also controls the constant current value of the FET 5 on the basis of data from a signal processing circuit-2. The signal processing circuit 2 is supplied with segment area data saved in a resistor or the like and deterioration data from a deterioration detecting circuit 1, and conducts predetermined arithmetic operation by using those data, thereby being capable of correcting a difference in luminance between the light emitting elements of the display element 6 and the degradation of luminance caused by the deterioration of the light emitting element.

The deterioration detecting circuit 1 measures a variation in the voltage-current characteristic of the display element 6 or the like and presumes the degree of deterioration to generate data for compensating the deterioration.

Figure 2:
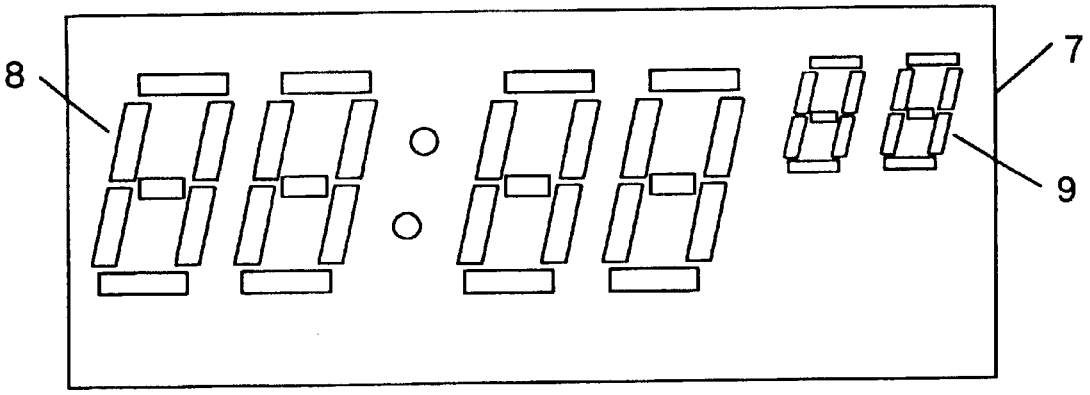
FIG. 2 is a plan view showing a light emitting indicator driven by the light emitting indicator drive circuit shown in FIG. 1.

FIG. 2 shows a display section of the light emitting indicator in accordance with the present invention. Referring to FIG. 2, a light emitting display panel 7 is provided with four figures of 7-segment display elements 8 which are relatively large and 8-shaped on the left side and two figures of 7-segment display elements 9 which are relatively small and 8-shaped on the right side. This is a light emitting display panel for indication of a watch in which those four figures on the left side indicate hours and minutes of a time and those two figures on the right side indicate seconds. There is a difference in area between the seven segments that constitute one display element 8, and also there is a difference in area between the display element 8 and the relatively small display element 9. It is necessary to drive the display elements while changing a driving current in correspondence with at least several kinds of areas.

Figure 3:
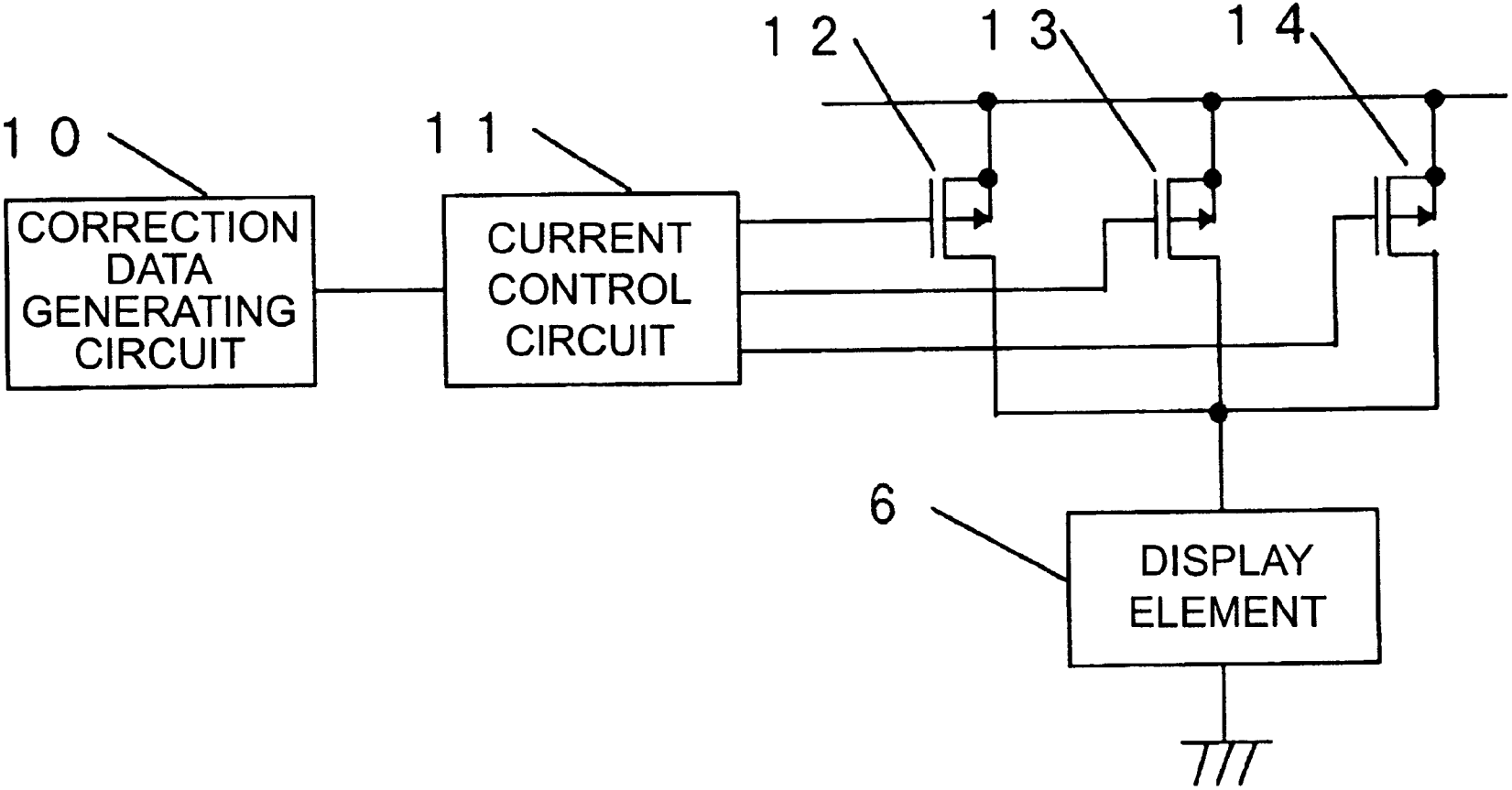
FIG. 3 is a circuit diagram for explanation of a driving current control in accordance with the present invention.

FIG. 3 shows a circuit diagram for explanation of a driving current control in accordance with a specific example of the present invention. One display element 6 is connected with three constant-current FETs 12, 13 and 14. In this example, it is proposed that the respective driving capabilities of those FETs 12, 13 and 14 are made different, for example, the respective current driving capabilities are set to 1:2:4. In this way, the current can be finely controlled by combinations of the on-states of a plurality of FETs different in current driving capabilities.

An output of the current control circuit 11 is added to the gates of the FETs 12, 13 and 14 to control the on/off operation of those FETs 12, 13 and 14. Further, segment area data or the like from a correction data generating circuit 10 is supplied to the current control circuit 11 to conduct current control in accordance with the data. With this structure, a current can be set in accordance with the segment area by the relatively simple structural circuit.

Figure 4:
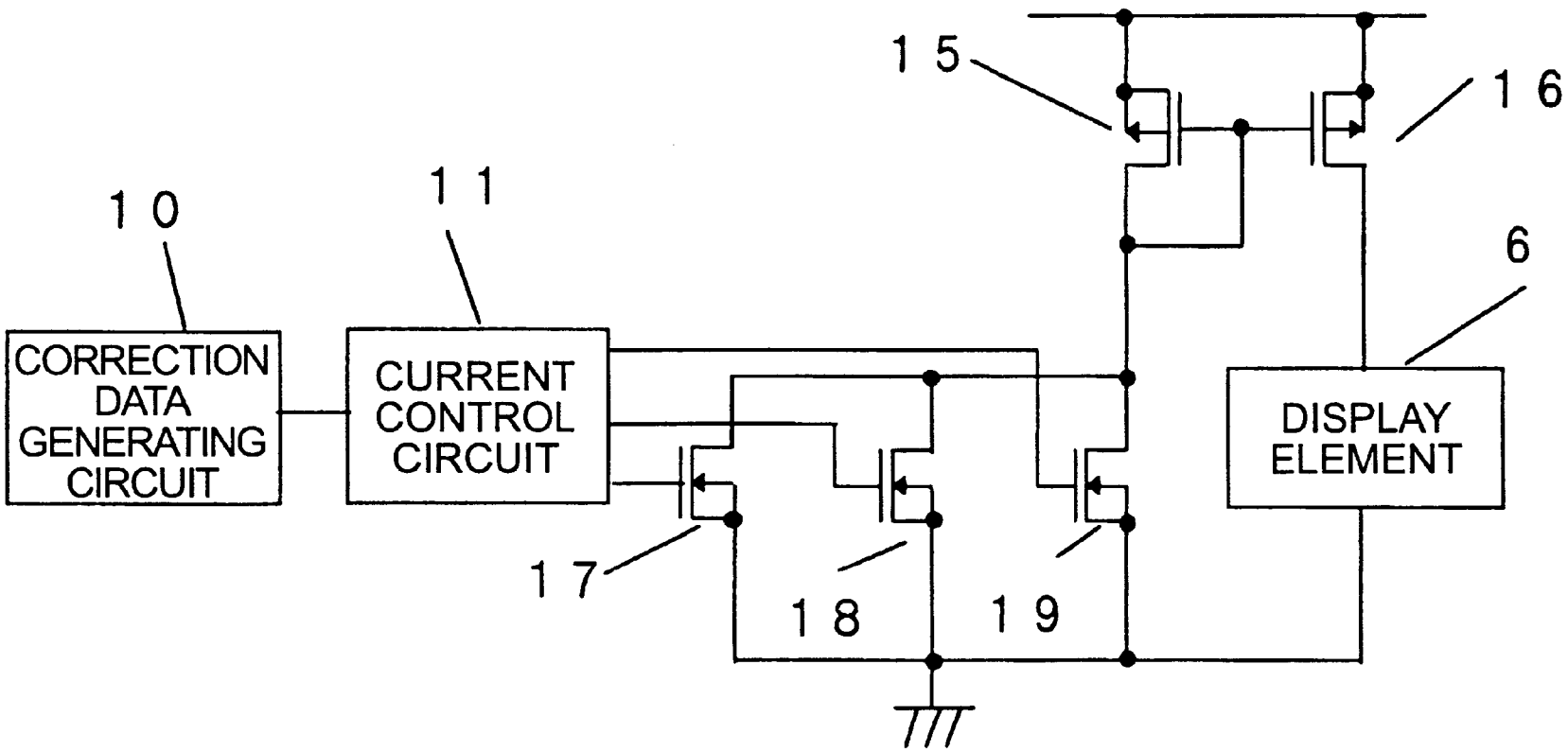
FIG. 4 is a circuit diagram for explanation of another driving current control in accordance with the present invention.

FIG. 4 shows a circuit diagram for explanation of a driving current control in accordance with another embodiment of the present invention. Referring to FIG. 4, an FET 16 is provided which current-drives one display element 6, and the gate of the FET 16 is connected with the gate and drain of an FET 15 to constitute a current mirror circuit. FETs 17, 18 and 19 are so designed as to supply a current to the FET 15, and the respective driving capabilities of those FETs 17, 18 and 19 are made different, for example, set to 1:2:4 as in the above-mentioned FETs 12, 13 and 14. The current control circuit 11 controls the on/off operation of the FETs 17, 18 and 19 as in FIG. 3, to finally control the driving current value of the FET 16. Since the correction data generating circuit 10 is structurally and operationally identical with that of FIG. 3, its description will be omitted. In this circuit, the FET 15 and FETs 17, 18 and 19 are advantageous in that small-sized FETs small in current driving capability can be employed therefor, and the FET 16 is high in the linearity of current control and easily dealt with.

Figure 5:
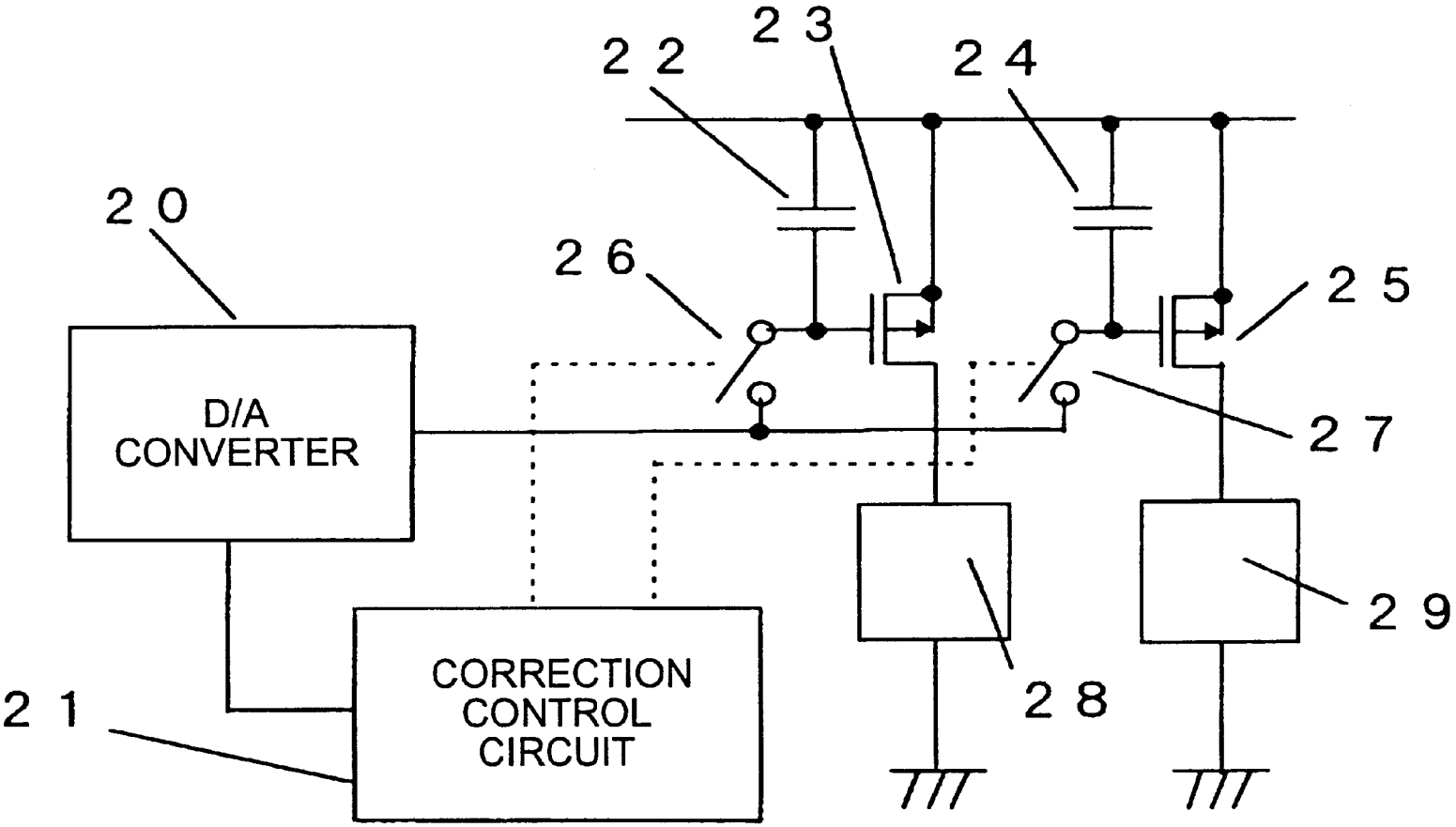
FIG. 5 is a circuit diagram for explanation of still another driving current control in accordance with the present invention.

FIG. 5 shows a circuit diagram for explanation of a drive current control in accordance with still another embodiment of the present invention. Two display elements 28 and 29 are current-driven by an FET 23 and an FET 25, respectively. The gates of those FETs 23 and 25 are connected with capacitors 22 and 24, respectively, so as to hold the gate voltages thereof, thereby controlling the currents in the FETs 23 and 25. In addition, the gates of the FETs 23 and 25 are connected with an output of a D/A converter 20 through switches 26 and 27, respectively. A correction control circuit 21 conducts the data setting and control of the D/A converter 20 and the control of the switches 26 and 27. The correction control circuit 21 initially sends data for setting the current of a display element 28 to the D/A converter 20 at the light emitting timing of two light emitting elements 28 and 29, and closes the switch 26 after the D/A converter 20 has outputted a control voltage for the display element 28. Then, the correction control circuit 21 charges the capacitor 22 up to the control voltage in a short period of time, and thereafter immediately opens the switch 26. The capacitor 22 holds the control voltage and supplies a substantially constant set current to the display element 28. After opening the switch 26, the correction control circuit 21 subsequently sends data for setting a current of the display element 29, and closes the switch 27 after the D/A converter 20 has outputted the control voltage for the display element 29. The correction control circuit 21 then charges the capacitor 24 and thereafter opens the switch 27. The above structure enables one D/IA converter 20 to conduct the current control of a plurality of constant current FETs, thereby being capable of reducing the circuit scale.

Figure 6:
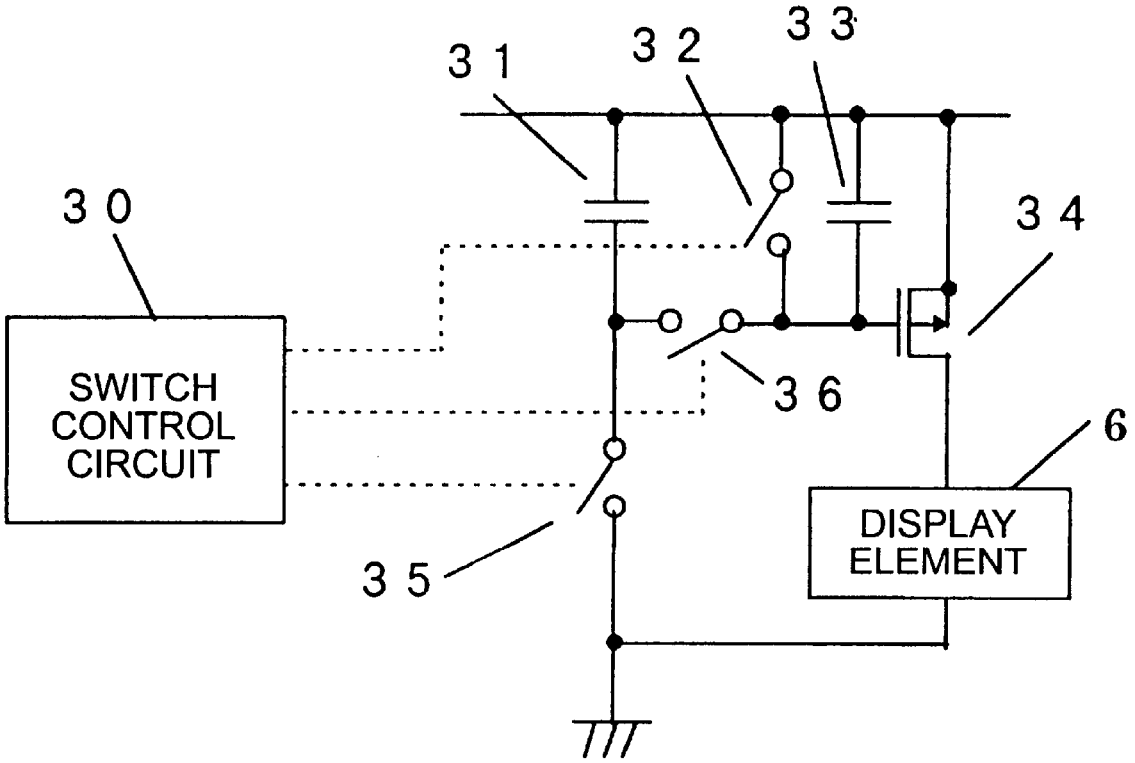
FIG. 6 is a circuit diagram for explanation of still another driving current control in accordance with the present invention.

FIG. 6 shows a circuit diagram of a driving current control in accordance-with still another embodiment of the present invention. A display element 6 is current-driven by an FET 34, and a capacitor 33 and a switch 32 are connected in parallel to each other between the gate and source of the FET 34. The gate of the FET 34 is also connected to one end of a switch 36, and the other end of the switch 36 is connected one end of the capacitor 31. Further, the other end of the capacitor 31 is connected to a plus power supply. A switch 35 is connected between a node of the capacitor 31 and the switch 36, and the ground. The switches 32, 35 and 36 are on/off controlled by a switch control circuit 30.

First, the switch 32 is turned on for a short period of time, to thereby discharge charges remaining in the capacitor 33. Then, the switch 35 is turned on to charge the capacitor 31 up to the ground potential. Thereafter, the switch 35 is turned off, and the switch 36 is turned on. With this operation, most of the charges in the capacitor 31 are carried to the capacitor 33, and thereafter the switch 36 is turned off. Since the capacitance of the capacitor 33 is larger than that of the capacitor 31, an increase in the potential difference of the capacitor 33 is relatively small. When the above control operation of the switches 35 and 36 is repeated while the switch 32 is kept off, the potential difference of the capacitor 33 and the voltage between the gate and source of the FET 34 increase in accordance with the number of times of repetition. As a result, a current that flows in the display element 6 can be controlled by the number of times of those operation.

Other then the above method, it is possible to use a method in which a capacitor is connected in parallel to the gate of an FET which supplies a current to a display element, and a repetitive pulse is supplied to the gate of the FET through a resistor, with the result that the pulse is smoothed by the resistor and the capacitor to supply a substantially constant voltage to the gate of the FET, thereby controlling a current in accordance with the duty ratio of the pulse.

Also, it is possible to dispose another FET in series to turn off the FET instead of a case in which the off-operation of the constant current FET is controlled by the gate voltage.

Subsequently, the generation of the area data of the display element will be described. As one means of generating the data, it is possible that digital data corresponding to the display element area is saved in a ROM (read only memory) in advance, and the area data is read out of the ROM in correspondence with an element which is going to emit a light and used for current control. The ROM may be programmable.

Figure 7:
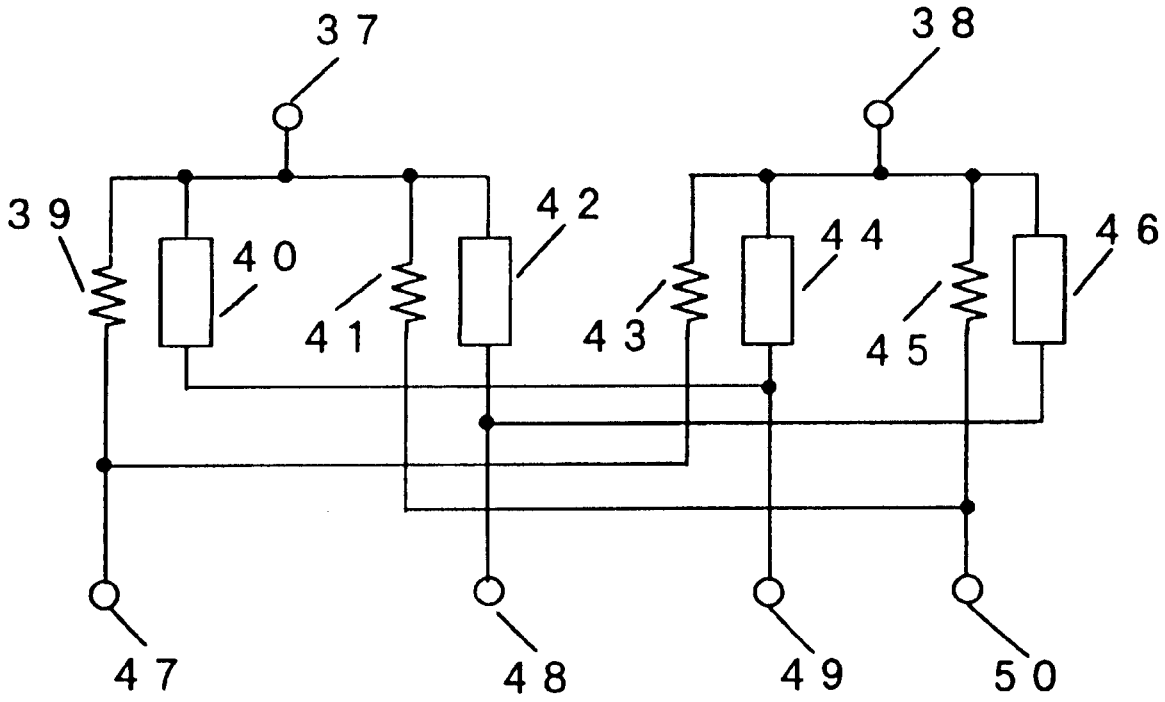
FIG. 7 is a circuit diagram showing the interior of a light emitting display panel for explanation of an example of a current correction data input in accordance with the present invention.
Figure 8:
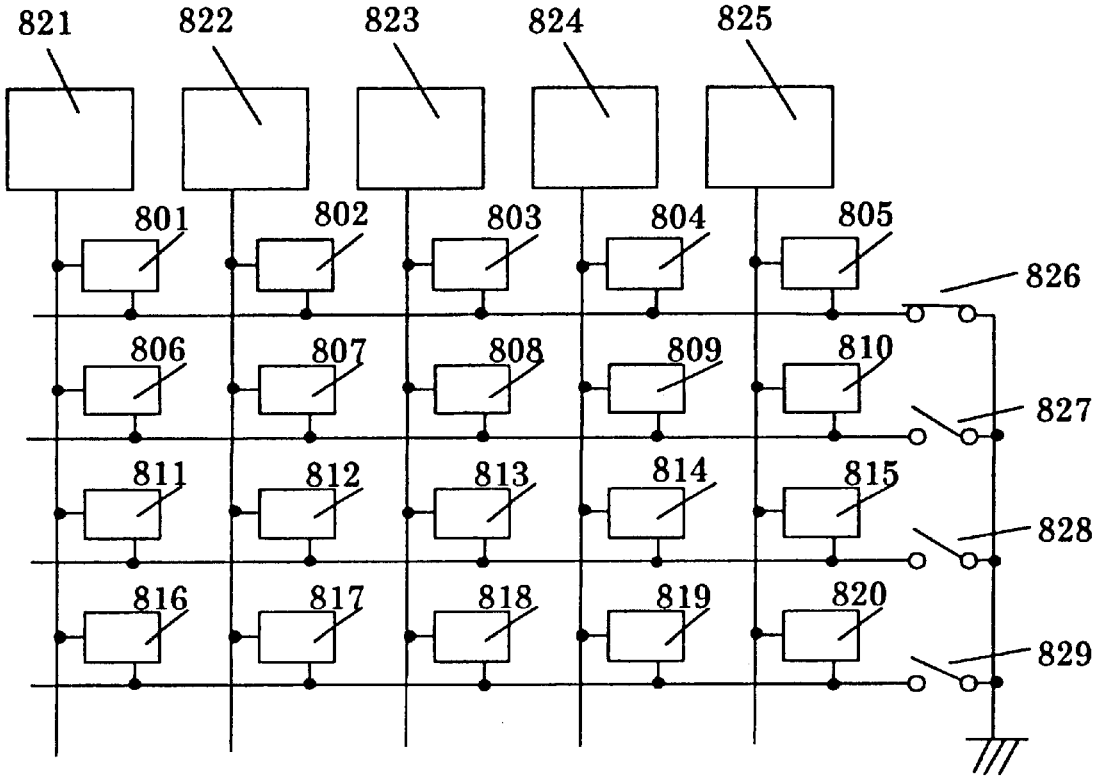
Prior Art FIG. 8
FIG. 8 is a circuit diagram showing a conventional example.
Figure 9:
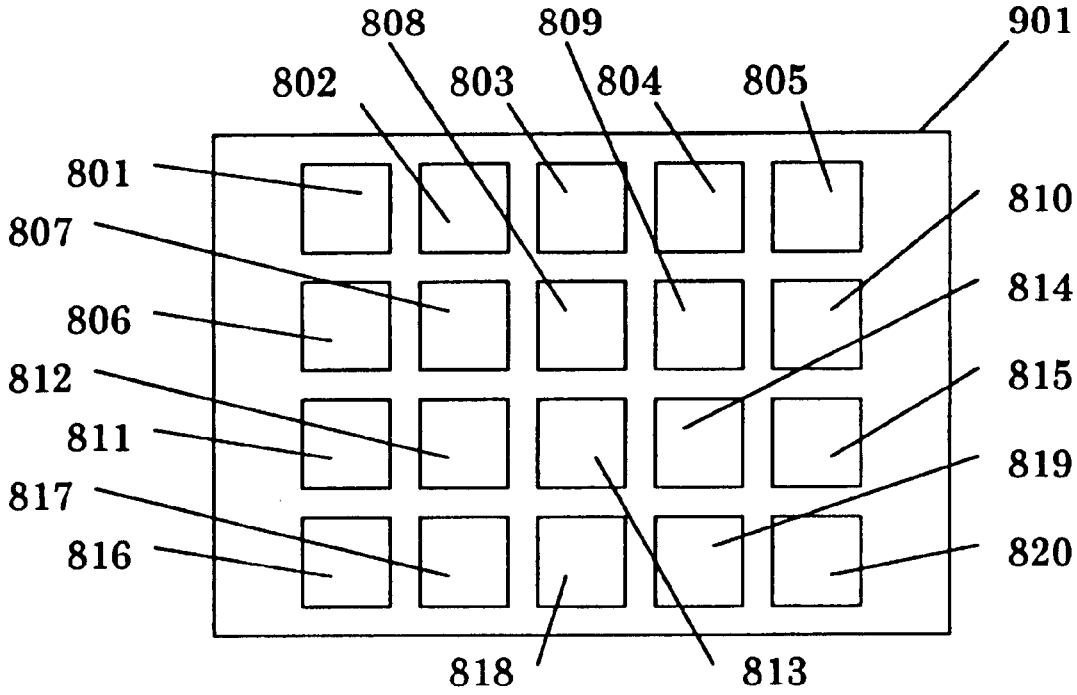
Prior Art FIG. 9
FIG. 9 is a plan view showing a light emitting indicator in the conventional example.

Also, FIG. 7 shows a structure according to another means. In the structure shown in FIG. 7, display elements and resistors having resistances corresponding; to the areas of those display elements are disposed within a light emitting display panel, thereby being capable of reading area information. In addition, high-resistant resistors 39, 41, 43 and 45 are disposed in correspondence with the areas of the display elements 40, 42, 44 and 46. Those resistors 39, 41, 43 and 45 may be formed of a transparent electrically conductive film or the like. Those components are connected to each other in the form of a matrix. In FIG. 7, the display element 40, the resistor 39, the display element 42 and the resistor 41 are connected to a terminal 37, and the display element 44, the resistor 43, the display element 46 and the resistor 45 are connected to a terminal 38. On the opposite sides of the respective components, the resistor 39 and the resistor 43 are connected to a terminal 47, the display element 40 and the display element 44 are connected to a terminal 49, the resistor 41 and the resistor 45 are connected to a terminal 50, and the display element 42 and the display element 46 are connected to a terminal 48.

The display elements 40, 42, 44 and 46 are selectively turned on by the combinations of the terminals 37, 38, 48 and 49. On the other hand, the resistors 30, 41, 43 and 45 are selected by the combinations of the terminals 37, 38, 47 and 50.

The selected resistor is divided by an external resistor, and a divided voltage is subjected to A/D conversion and then read. This measurement is conducted in an area data measuring mode separated from the display operation, and executed once when initialization is conducted at the time of replacement or the like, and the area information is saved in a memory.

If the resistance values of the resistors 39, 41, 43 and 45 are made small, a leak current flows between the terminals 37 and 38, as a result of which a current also flows in a display element which is not turned on so that the display element slightly emits a light. In order to prevent this drawback, a resistance value of at least several tens k or more is required, and several hundreds k or more is desired. Also, in order to reduce the above cross-talk, it is desirable to additionally connect a diode in series with a matrix of resistors. There is proposed that a small-sized light emitting diode which masks light emission is employed as the diode.

On the other hand, the measurement of the resistances is affected by the display elements 40, 42, 44 and 46. In order to reduce the influence, it is necessary to lower a voltage which is added to the resistor for measurement, and it is desirable to limit the voltage to about 1 to 2 V.

In addition, if a constant voltage is applied to the respective display elements to measure the current flowing therein, the area information can be read because the current and the area are nearly proportional to each other. Also, the electrostatic capacitance components of the respective display elements can be obtained by measuring an a.c. impedance or a CR time constant.

As was described above, according to the light emitting indicator drive circuit of the present invention, even in a fine character display and a segment display which is low in power and low in costs, a variation in luminance between the respective segments can be reduced to a level where an operator is hardly aware of the variation in luminance. For that reason, if the light emitting indicator drive circuit is applied to a product such as an arm watch which requires a small size, a low power, low costs and fashionability, the degree of completion as the product can be enhanced. Thus, the present invention can obtain large advantages.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A light emitting display device, comprising:

a light emitting indicator having a plurality of light emitting elements for emitting a light in response to application of a current, at least some of the light emitting elements having different areas;

a constant-current source for supplying a constant-current to the respective light emitting elements; and a current control circuit for controlling the value of the constant current which is generated by the constant current source without the use of an impedance element to an output of an active element of the constant-current source so that the current supplied to a respective light emitting element has a value corresponding to the area of the respective light emitting element.

2. A light emitting display device according to claim 1; wherein the constant-current source comprises a FET; and the current control circuit controls the gate voltage of the FET; so that the current supplied to a respective light emitting element has a value corresponding to, the area of the respective light emitting element.

3. A light emitting display device according to claim 2; further comprising means for storing area information of the plurality of light emitting elements; and wherein the current control circuit reads the area information to correct the gate voltage of the FET to maintain the light emitting luminance of the plurality of light emitting elements substantially constant.

4. A light emitting display device according to claim 2; further comprising a deterioration detecting circuit for detecting deterioration of a light emitting characteristic of a light emitting element; and a signal processing circuit for processing deterioration information output by the deterioration detecting circuit and area information of the plurality of light emitting elements; wherein the current control circuit controls the gate voltage of the FET to reduce deterioration of the light emitting luminance caused by the degradation of the light emitting element on the basis of output data of the signal processing circuit so that the light emitting luminance of the respective light emitting elements is maintained substantially constant.

5. A light emitting display device according to claim 2; wherein the constant-current source further comprises at least another FET having a different driving capability from the first-mentioned FET; and the current control-circuit controls the gate voltage of the respective-FETs to control the value of the current supplied a respective light emitting element corresponding to the area thereof.

6. A light emitting display device according to claim 3; further comprising a plurality of resistors each corresponding to a respective light emitting element and each having a resistance value corresponding to the area of the corresponding light emitting elements.

7. A light emitting display device according to claim 1; wherein the constant-current source comprises a plurality of transistors each having a different driving capability; wherein the current control circuit selects one or more of the transistors to control the value of a current supplied to a respective light emitting element according to the area thereof.

8. A light emitting display device according to claim 7; wherein the constant-current source further comprises a current mirror circuit for supplying a constant current to the light emitting elements.

9. A light emitting display device according to claim 1; wherein the constant-current source comprises a constant-current FET and at least one charge storage device connected to a gate of the FET; wherein the current control circuit charges the charge storage device to a desired level to control the gate voltage of the constant-current FET to control the value of a current supplied to a respective light emitting element according to the area of the respective light emitting element.

10. A light emitting display device according to claim 1; wherein the constant-current source comprises a constant-current FET and a charging circuit comprising a plurality of charge storage devices and switches connected to a gate of the constant-current FET; wherein the current control circuit successively controls the switches to build up a charge level in a charge storage device connected to the gate of the constant-current FET to control the value of a current supplied to a respective light emitting element according go the area of the respective light emitting element.

11. A display device comprising: a display element having a plurality of segments at least some of which have a different area from each other; a constant current source for supplying a constant-current to drive the respective segments; and a current control circuit for controlling the value of the constant-current which is generated by the constant-current source according to the area of the respective segments without the use of an impedance element to an output of an active element of the constant-current source.

12. A display device according to claim 11; wherein the current source comprises a plurality of transistors; and the current control circuit selects one or more of the transistors to control the value of the current supplied to a respective segment based on the area thereof.

13. A display device according to claim 11; wherein the current source comprises a FET.; and the current control circuit controls a gate voltage of the FET to supply a current to a respective segment having a value corresponding to the area of the respective segment.

14. A display device according to claim 11; further comprising means for storing area data representative of the area of the respective segments; and the current control circuit reads the area data to control the current supplied to the respective segments to maintain the luminance of the plurality of segments substantially constant.

15. A display device according to claim 11; further comprising a deterioration detecting circuit for detecting luminance deterioration of the respective segments.

16. A display device according to claim 15; further comprising a circuit for processing deterioration information output by the deterioration detecting circuit and area information of the plurality of light emitting elements; wherein the current control circuit controls the current supplied to the respective segments to maintain the luminance of the plurality of segments substantially constant.

17. A display device according to claim 11; further comprising a plurality of resistors each corresponding to a respective segment and each having a resistance based upon the area of the corresponding segment.

18. A display device according to claim 11; wherein the current source comprises a FET and at least one charge storage device connected to a gate of the FET; and wherein the current control circuit charges the charge storage device to a desired level to control the gate voltage of the FET to control the value of a current supplied to a respective segment according to the area thereof.

19. A display device according to claim 11; wherein the current source comprises a FET and a charging circuit comprising a plurality of charge storage devices and switches connected to a gate of the FET; and wherein the current control circuit successively controls the switches to build up a charge level in a charge-storage device connected to the gate of the FET to control the value of a current supplied to a respective segment according to the area thereof.

* * * * *